United States Patent [19]

Krivec et al.

[11] Patent Number: 4,631,940

[45] Date of Patent: Dec. 30, 1986

[54] DIGITAL READOUT COMBINATION LOCK DIAL ASSEMBLY

[75] Inventors: Bert Krivec; Gary R. Murphree, both of Lexington, Ky.

[73] Assignee: Sargent & Greenleaf, Inc., Nicholasville, Ky.

[21] Appl. No.: 718,006

[22] Filed: Mar. 29, 1985

[51] Int. Cl.[4] ..... E05B 1/00

[52] U.S. Cl. ..... 70/332; 70/DIG. 59; 340/762

[58] Field of Search ..... 70/332, 333 A, 330, 70/331, DIG. 51, DIG. 59, 432, 433, 436, 445; 340/762; 250/231 SE; 350/110

[56] References Cited

U.S. PATENT DOCUMENTS

| | | | |
|---|---|---|---|
| 1,880,105 | 9/1932 | Reifel | 70/DIG. 51 X |
| 3,702,070 | 11/1972 | Gartner | 70/DIG. 51 X |
| 3,764,859 | 10/1973 | Wood et al. | 70/DIG. 51 X |
| 3,835,680 | 9/1974 | Evans | 70/333 A X |
| 4,099,172 | 7/1978 | Montanari et al. | 340/762 X |
| 4,241,343 | 12/1980 | Fan et al. | 340/762 X |

*Primary Examiner*—Robert L. Wolfe
*Assistant Examiner*—Lloyd A. Gall
*Attorney, Agent, or Firm*—Mason, Fenwick & Lawrence

[57] ABSTRACT

A selectively illuminated digit display combination lock dial assembly to be coupled to the spindle of a combination lock for dialing a lock opening combination of numbers, including a rotatable dial member to dial the numbers of the combination, a dial backup case to be mounted on a security container having a coupling member journaled therein connected with the spindle and with the dial member. The backup case having a sight passage and digit numeric generating and display device located outwardly of the dial member periphery to generate and visually display numbers signifying the dial member angular positions. An encoder disc is rotated in correlation with the coupling member having plural light passing slots for activating sensors to produce electrical count signals, and electronic circuitry counts the count signals and senses direction of dial rotation to activate the numeric display device to show numeric dial positions upon reaching a first number of revolutions and to activate the numeric display device to show numeric dial position when predetermined numbers of revolutions are reached in a predetermined sequence.

19 Claims, 11 Drawing Figures

Fig-1
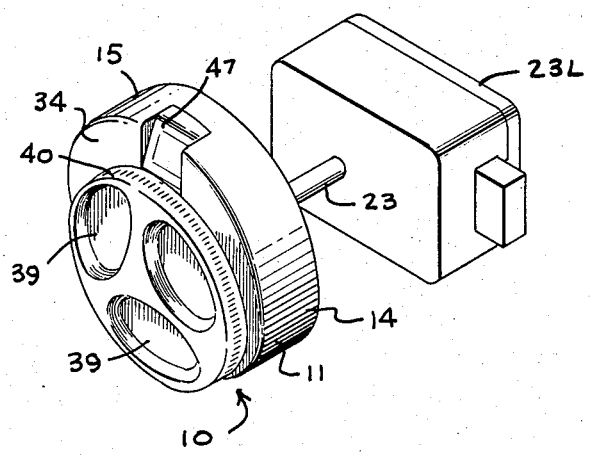
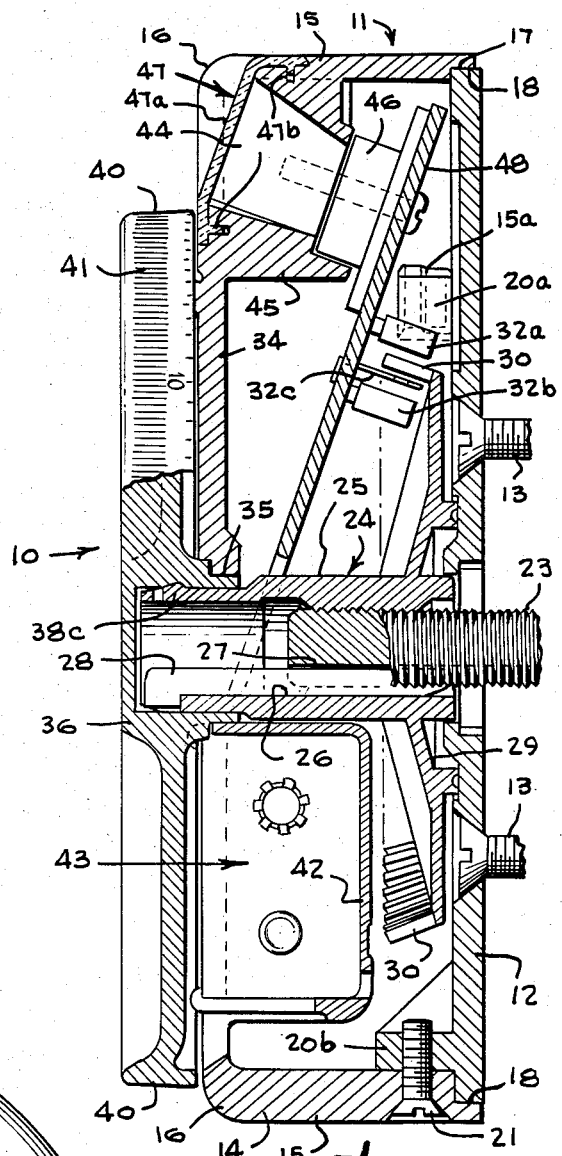
Fig-3
Fig-2
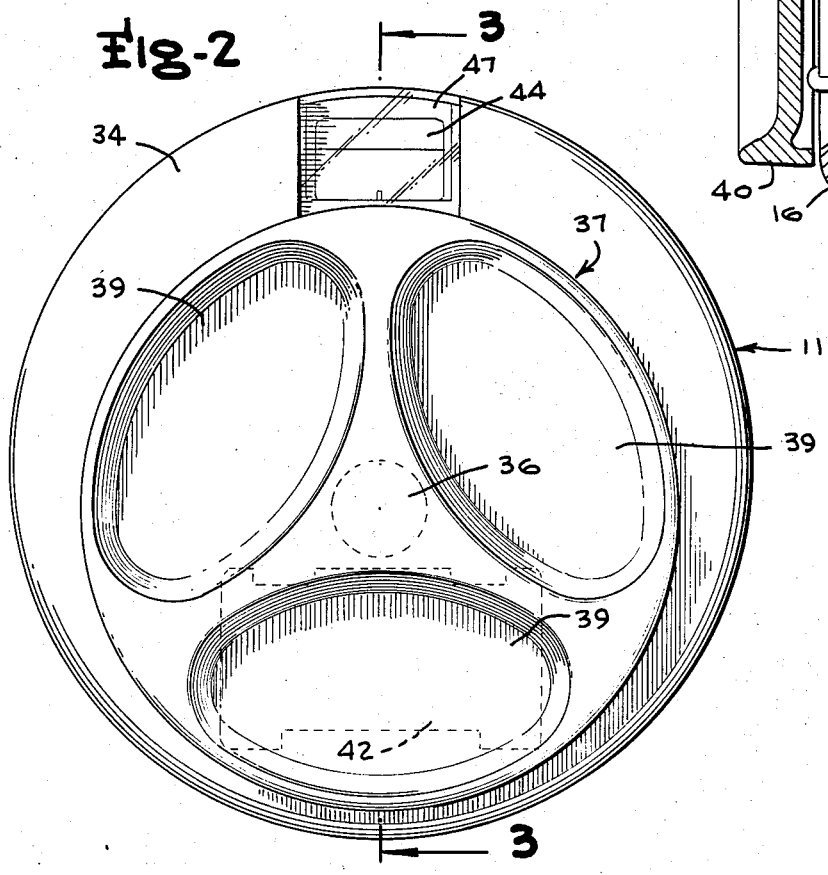

DIGITAL READOUT COMBINATION LOCK DIAL ASSEMBLY

BACKGROUND AND OBJECTS OF THE INVENTION

The present invention relates in general to combination locks, and more particularly to dial mechanisms for combination locks having a dial knob and associated dial back-up case with a digital readout display rather than the usual numerical indicia on a rotating dial member.

Heretofore, combination lock dial and dial ring assemblies for combination locks have customarily employed a unitary dial and dial knob member wherein the dial is of a disc like configuration, usually having a slightly tapered or conical indicia bearing face with graduation marks and numerals thereon, while the dial knob portion projects forwardly from the center thereof and is also usually in a truncated conical configuration providing a circular front end face and is usually provided ribs, serrations, knurled surface formations, or other friction increasing surface treatment of the conical surface of the unitary dial and knob member. The dial portion of the unitary dial and knob member customarily is received in a cylindrical well of only slightly larger diameter than the outer diameter of the dial portion formed in a dial ring or outer surround formation, sometimes referred to as an escutcheon plate, encircling the dial portion of the knob and dial member. Other combination lock dial and ring assemblies have taken the form of a shield or cover of tubular cylindrical configuration having an interruption providing a viewing window or opening, encircling a peripheral cylindrical flange surface of a cylindrical dial portion of a unitary dial and knob member, with the dial markings and numerals provided on the peripheral cylindrical flange surface of the dial portion. Thus the view opening or window forming interruption of the shield or cover of the dial ring exposes only a limited number of the dial markings to view, for the purpose of reducing the field or area in which the dial numbers can be observed while the operator knowing the combination is dialing the opening combination, thus limiting the range of exposed dial markings which are visible to unauthorized persons, and also to facilitate viewing of the dial markings by the authorized operator along a sight axis directed almost vertically downwardly. Examples of these last-described types of dial and ring assemblies may be found in U.S. Pat. No. 2,690,664 to Harry C. Miller and U.S. Pat. No. 4,197,726 to Uyeda.

It has been recognized for a number of years that one of the difficulties with conventional combination lock dial assemblies has been the problem of misdialing a combination lock by failing to rotate the dial and knob assembly through the proper number of turns in each direction through the proper dialing procedure for opening the lock. As is well known to persons skilled in the combination lock field, combination locks with the usual three tumbler wheel pack and driving cam mechanism most prevalent in combination locks require rotation of the combination lock through at least three complete revolutions in a first direction followed by alignment of the proper first combination number with the fixed index mark, then rotation of the dial through at least two complete revolutions in an opposite second direction to the alignment position for the next dial number with the index mark, followed by one complete revolution in the first direction to align the last of the three combination numbers with the index mark, and then the dial is rotated to a zero or opening position to effect interlinking of the fence lever, pivoted to the slidable bolt, with the peripheral gates in the tumbers and the driving cam gate to effect retraction of the bolt to open the lock. Frequently, misdialings occur because the operator fails to rotate the dial and knob assembly through the proper number of complete turns in one of the successive steps in the procedure, resulting in an accidental misdialing of the combination. Since many combination locks in very high security installations also frequently have devices associated therewith for producing alarms when the combination is misdialed or automatically achieving a lock-out of the lock when a misdialing occurs, this can present considerable time loss problems or require assistance of skilled locksmiths or security personnel to clear the combination lock for another proper dialing procedure.

Also, many misdialing errors occur where the combination lock is located in poor lighting conditions, particularly where limited sight openings or sight angles are incorporated in the dial system to limit unauthorized observation of dialing of the combination. Where alarm systems are incorporated in the combination lock system to generate alarms or lockouts when the combination is misdialed, this can also produce undesired time loss or occupation of security or highly skilled personnel.

An object of the present invention is the provision of a novel combination lock dial system, wherein a digital display of the combination number being dialed is presented by a light emitting source, such as light emitting diodes (LED's), permitting the operator to readily see the combination numbers being dialed in poor lighting conditions, or even in the dark.

Another object of the present invention is the provision of a novel illuminated electronic dial assembly for combination locks, providing a digital light generating readout displaying the numerals corresponding to the position of the dial in accordance with a usual combination lock dialing numerical system.

Another object of the present invention is the provision of a novel illuminated electronic dial assembly for combination locks, wherein a digital readout dial is provided which produces light source numerical displays of the numerals representing the dial angular position, and wherein the readout display does not light up until the dial has been advanced through the correct number of turns in the proper direction for the prescribed dialing procedure to open the lock.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a front perspective view of an illuminated electronic digital display type combination lock dial assembly embodying the present invention;

FIG. 2 is a front elevational view of the illuminated electronic digital display combination lock dial assembly;

FIG. 3 is a vertical section view thereof taken along the line 3—3 of FIG. 2, shown to enlarged scale;

DETAILED DESCRIPTION OF A PREFERRED EMBODIMENT

Figure 4:
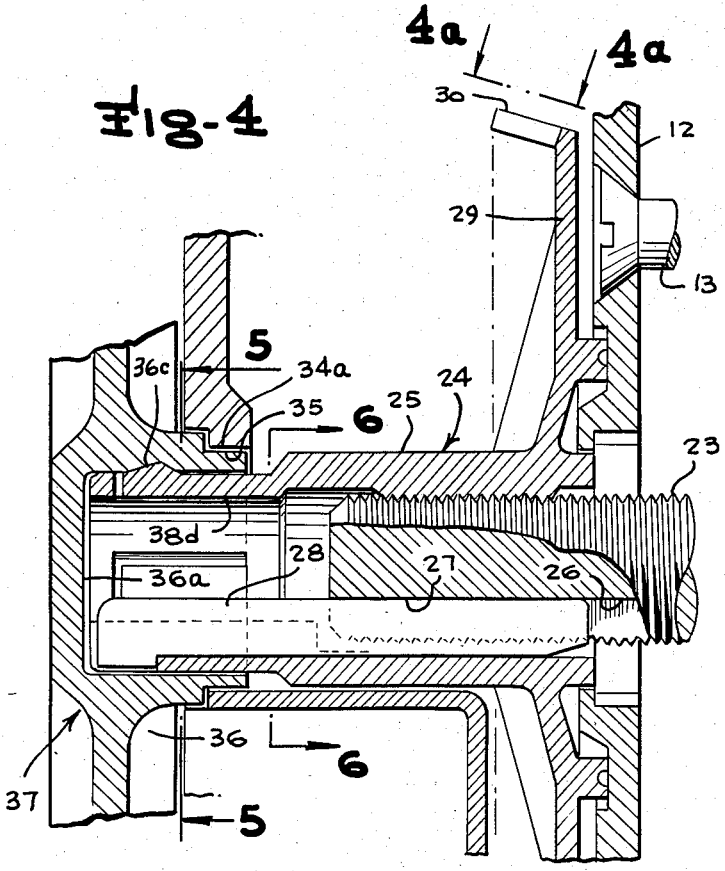
FIG. 4 is a fragmentary enlarged section view of the encoder hub member.

Referring to the drawings, wherein like reference character designate corresponding parts throughout the several figures, the digital readout dial assembly of the present invention is indicated generally by the reference character 10 and comprises a dial assembly base housing 11 of generally cylindrical configuration formed of a circular backup plate 12 to be mounted on or fixed to the front surface of the security container closure, for example the vault or safe door or file cabinet drawer front, or the like, by conventional mounting screws 13, to which is assembled a rearwardly facing generally cup shaped front case component 14 having a cylindrical outer wall 15 forming the encircling side wall portion of the housing component 14. The cylindrical outer wall portion 15 is rounded at its forward corners, indicated at 16, and has an annular recess 17 along the inner edge of the rearmost end of the cylindrical outer wall 15 to interfit with and receive a portion of the periphery 18 of the backup plate 12. At cylindrically spaced locations along the perimeter of the backup plate 12 located near the periphery thereof are a pair of snap-on hook formations 20*a* and a screw receiving shoulder formation 20*b* projecting forwardly and appropriately tapped to receive coupling screw 21 to fix the front case component 14 to the backup plate 12. The hook formations 20*a* interlock with catch shoulders 15*a* on the case wall 14 to provide the snap action latching at these locations.

Figure 4A:
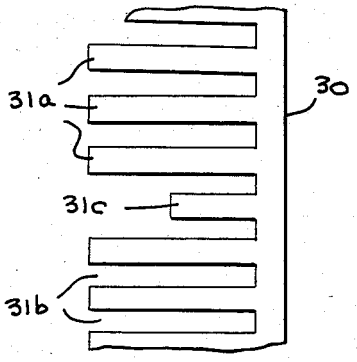
FIG. 4*a* is a fragmentary flat development view, taken along the line 4*a*—4*a* of FIG. 4, showing part of the pattern of encoder teeth and gaps.
Figure 4B:
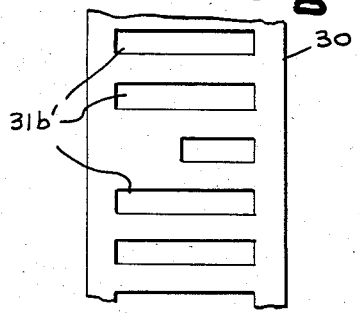
FIG. 4*b* is a fragmentary showing of another version of encoder.
Figure 5:
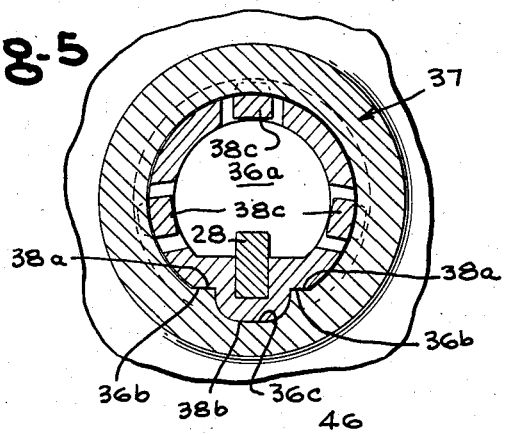
FIGS. 5 and 6 are fragmentary section views taken along lines 5—5 and 6—6 of FIG. 4.
Figure 6:
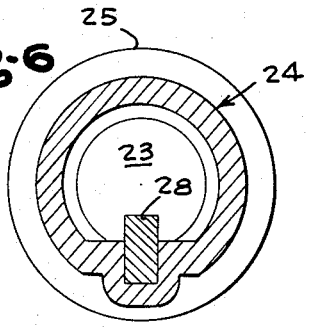

The circular backup plate 12 is apertured at an eccentric location relative to its center axis spaced vertically below the center axis to receive the forwardly projecting combination lock spindle 23, which may be a conventional dial operating spindle for combination locks, indicated at 23L, of the type having plural wheel tumblers and a driving cam. In the illustrated embodiment, the forward portion of the combination lock spindle 23 is received within and keyed to a combined encoder disc and hub member 24 having a cylindrical tubular central hub portion 25 sized to receive the forward end portion of the spindle 23 and having a kerf 26 opening through the front of the hub portion 25 to be aligned with a groove or kerf 27 in the forwardmost portion of the spindle 23 to receive an interlocking key 28 inserted from the front during assembly of the encoder disc and hub member 24 on the combination lock spindle. Projecting radially outwardly from adjacent the rear of the central hub portion 25 is a disk portion 29 terminating in a forwardly inclined annular skirt-like rim 30 of alternating rectangular teeth 31*a* and gaps 31*b* having a predetermined pattern providing opaque and transmissive zones, as illustrated in FIG. 4*a*, to coact with two optical sensor pairs 32, 33 formed of light emitters such as LED's indicated at 32*a*, 33*a* and light receivers such as photodiodes indicated at 32*b*, 33*b*. Alternatively, the gaps may be slots as shown at 31*b*' in FIG. 4*b*.

An opening 34*a* for the forwardmost portion of the central hub portion 25 of the encoder disc and hub member 24 concentric with the extended axis of the spindle 23 is provided in the front wall portion 34 of the front case component 14 and is of a large enough diameter to receive a rearwardly projecting lip 35 extending rearwardly from the central hub portion 36 of the dial member 37. The socket 36*a* in hub portion 36 is deformed along one portion thereof to provide flats 36*b*, 36*b* and a radially outwardly extending well 36*c* to receive and interfit with similar flats 38*a*, 38*a* and a tongue formation 38*b* on the forwardmost portion of the central hub portion 25 of encoder hub member 24, and this portion of the hub portion 25 is shaped to provide catch nose formations 38*c* on resiliently deformable legs 38*d* to snap into detent recesses in the confronting surface the socket 36*a* to capture the dial member 37 on the encoder member 24. The dial member 37 in the illustrated embodiment has three forwardly opening oval cavities 39 bottomed by thin annular web portions extending from the central hub portion 36 to near the outer peripheral rim flange 40 of the dial member which is axially enlarged and which may be roughened on the outer surface, as indicated at 41, by knurled surface deformations, serrations, or ribs, to facilitate manipulation of the dial member and in the illustrated embodiment has a slight forwardly converging taper.

The front wall 34 of the housing component 14 of the dial assembly case 11 is provided with a generally rectangular forwardly opening well 42 forming a battery compartment for a 9 volt battery 43, and an upwardly and forwardly inclined sight opening 44 is provided above the dial member 37 in the upper portion of the lock case centered above the center axis of the dial extending through a thickened upper mounting formation 45 of the housing 14 shaped to receive the forwardmost portions of an LED digit block 46 supported on a printed circuit board 48 having the integrated circuit chips and electrical components and circuitry for responding to sensor signals from the optical sensors 32 and 33 sensing the turns of the dial member 37 and spindle 23 and controlling turning on and off of the stroke segments of the LED digits in accordance with the program of proper turns and direction of turning of the dial member and the angular positions indicating dial number positions of the dial member. A thin aperture element 32*c* providing two beam-passing apertures is mounted on the PCB 48 and extends between the light emitters and light receiver photodiodes of the optical sensor pairs 32, 33 below the skirt or rim 30 of alternating teeth and gaps 31*a*, 31*b* to simplify the installations requirements for the optical elements and obtain consistency of diode signal output. To protect the sight opening 44 and components located within the base housing 11 from moisture, spillage and the like, a transparent window cover member 47 of clear plastic material is provided having a front face 47*a* which covers and closes the opening and peripheral portions provided with inwardly extending rib formations 47*b* to interfit into recesses in the front and side wall portions 34 and 15.

Figure 9:
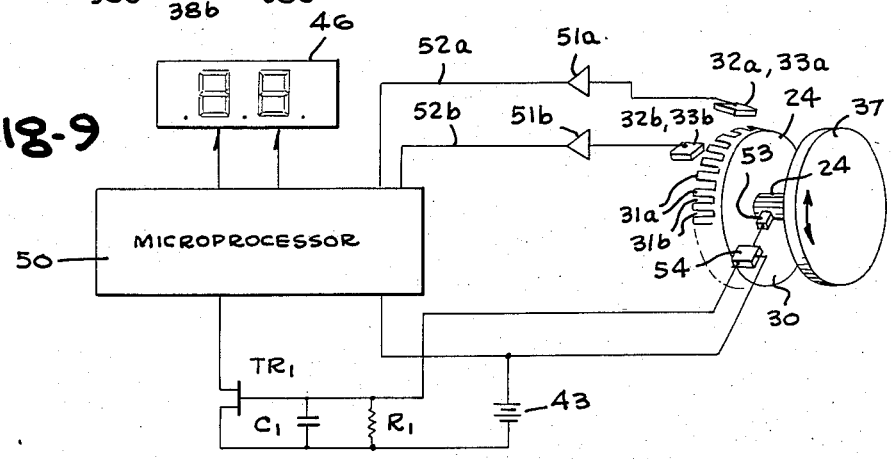
FIG. 9 is a partially schematic block diagram of the electrical system of the lock shown with diagrammatic illustrations of the dial knob and encoder and associated optical and switch devices.
Figure 7:
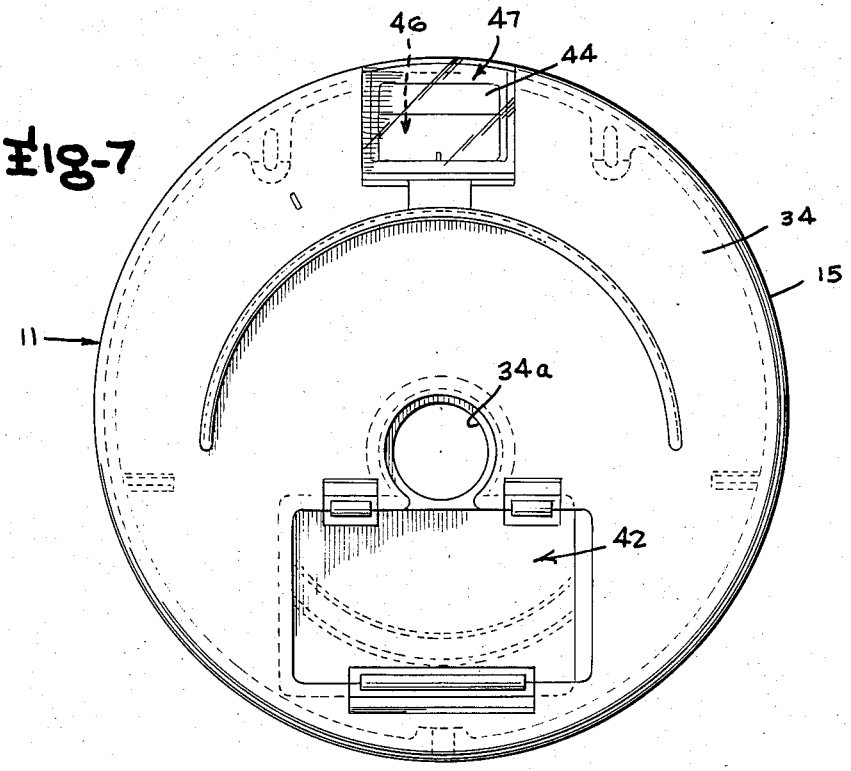
FIG. 7 is a front elevational view of housing component of the backup case shown as a separate part.
Figure 8:
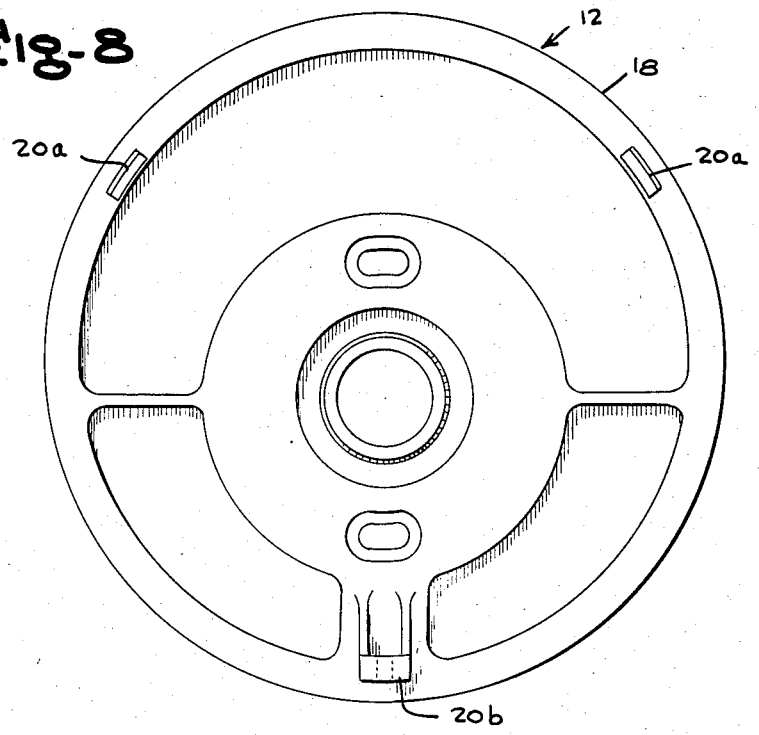
FIG. 8 is a front elevation view of the backup plate, shown as a separate part.

Mounted on the printed circuit board 48 is a microprocessor indicated at 50 in FIG. 9 which contains the operating instructions and circuitry for controlling the actions of the display produced by the LED two digit display 46, as well as reading of the encoder skirt or rim 30 by the optical sensors 32, 33 and determining the rotational position of the dial and the direction of dial rotation. It also makes decisions on the validity of the operator's actions and maintains or interrupts the process accordingly. The microprocessor 50 as shown in FIG. 9, receives amplified and processed signals from the photodiodes of the optical sensor pairs 32, 33 through signal processing stages 51*a*, 51*b* along leads 52*a*, 52*b*, and the hub portion of the encoder and hub member 24 has an activating projection or protrusion 53 coactive with a motion activated switch 54 of a known commercially available type to sense rotary motion of the dial spindle 23 and hub 25 of the encoder disc and hub member 24 to apply power to the microprocessor 50 accordingly. If motion is absent for more than a preset length of time, the power switch 54 automatically turns off power to the electronics, and the switch is of the type which is activated only under motion and not in any static dial position. Because of this, considerable battery power is conserved because the motion actived switch 54 permits power to be supplied to the electronics only while the knob 37 and the associated spindle 23 and hub 25 are in motion.

The circuitry associated with the motion activated switch 54 is such that when the actuator 53 on the hub 25 is rotated, the switch 54 is momentarily actuated to charge a capacitor C1 associated with a resistor R1 across leads from the switch 54 and battery 43 and connected to the gate of a field effect type transistor TR1. When the capacitor charging circuit is driven directly from the battery, the charging circuit will have a time constant of less than 100 microseconds with a capacitor of up to 10 microfarads. This will allow a holding time of up to 10 seconds for the gate voltage to the field effect transitor TR1 to keep the transistor at a low impedance, providing power to the electronics.

The arrangement is such that the display from the LED display unit 46 shows the operator that the unit is active, that he is turning the dial properly, that he can select the proper number for activating the lock, or that he is in either the operate or change mode, and will also show when the battery power is low. The display from the LED display unit 46, as previously stated is a two digit display where each digit is made up of multiple segments, in the preferred embodiment, although the display could be of liquid crystal, vacuum florescent, or other known display types.

By providing the power switch formed by the activator 53 and motion activated switch 54 providing power to illuminate numeric displays from the LED display unit 46 responsive to rotation of the dial knob and its associated shaft, the display is arranged so that it remains dark until the operator is at the proper rotation or revolution cycle of the dial that he will use to change direction, thus preserving battery life, helping to maintain lock security, and freeing the operator from turns counting. Wherever this is accomplished in the present embodiment without requiring combination numbers to be stored in a memory in the electronics to know when the dial is in the proper rotation position to activate the display.

The present invention differs from normal operation of combination lock dials in that it requires that the operator start by rotating the dial past a reference point (the "zero" point) a set number of times, stopping at the first number of the opening combination. The LED block display 46 is enabled only after the dial rotation passes zero the preset number of times and stays on until the operator changes direction, presumably but not necessarily at the proper combination opening number. The display goes out or into an off condition wherein no light is being emitted by the LED's at direction reversal, and stays in the off or nonilluminated condition until the first number of the dialing combination is passed a preset number of times, whereupon the display again comes on and lets the operator select his second number of the opening combination and change direction. The display then goes off again, until the previously dialed number has been passed the prescribed number of times and then turns on to permit the operator to select the last number of the combination while the LED block is illuminated. While the normal prior art method of dialing would require knowledge by the electronics of the next number to be chosen in the opening combination, the present invention requires only knowledge by the electronics of the last number chosen to control display. When motion stops and the power switch deactivates the electronics, all memory is lost, insuring security of the unit.

The microprocessor 50 is made in accordance with standard microprocessor techniques and is provided with counters and must have a display driver capability. The encoder 30 in the illustrated embodiment is integrally formed with the hub portion 25 and disc flange portion 29 and for a standard 100 increment lock dial, a 200 increment encoder is preferred to provide accuracy in spite of the normal plus-or-minus 1 count resolution of simple electronic counters. Two sets of sensors 32, 33, formed of LED emitters 32*a*, 33*a* and phototransitors 32*b*, 33*b* are used, positioned, and masked by the aperture element 32*c*, so that one set is reading an edge of the tooth or gap 31*a*, 31*b* while the other set is reading the middle of a gap or tooth. By detecting if a gap 31*b* or a tooth 31*a* is present when a rising edge or falling edge is in transition, direction of rotation is established. This of course is a standard technique for optical encoders. A reference tooth 31*c* is provided which is shorter than all the others to identify a standard reference point of rotation, which in the illustrated embodiment is the zero dial position.

For determining position, the microprocessor 50 notes the reference position and direction of rotation and instructs one of its counters to count upward or downward once for each tooth or gap transition sensed by the sensors 32, 33. In similar fashion, the microprocessor can determine the position of the dial each time direction of rotation is reversed, and can count the complete number of revolutions turned to control the on/off functions of the LED display 46. Once the display 46 is turned on, the counter in the microprocessor will display the position as a two-digit number (00–99 on a 100 increment dial). Using two sets of sensors 32, 33 allows lowest battery power and longest life.

By virtue of the programming of the microprocessor, the display is controlled to aid the operator in the use of the dial to open the lock. A "wake up" feature may be provided wherein, when motion has been detected, in the proper direction, a segment of the digital display, for example the horizontal middle bars or segments on the LED characters, is illuminated, showing both motion and verifying direction of rotation. When the proper number of turns has been made in the proper direction, the digital display 46 then shows numbers starting at 00 and increments upwardly or downwardly as appropriate. When the operator gets to the first digit of the opening code and stops, he then changes direction of rotation which causes the digits on the display to go dark except for the segment or bar indicating direction. Following dialing of the first number, the dial is rotated in the proper direction until the dial has rotated the proper number of turns past the first number of the opening code. When this is reached, the display 46 is turned on allowing the operator to set the second number and then change direction, which causes the display to go off again.

The same procedure is followed for the successive number of rotational cycles required depending on the number of tumbler wheels of the combination lock. The microprocessor keeps track of the proper number of turns for the initial "wake up" rotation and each subsequent rotation. Operation assumes that the operator knows the proper code and the number of digits in the opening combination. The dial assembly may help the operator to slow down the rotation just before the display comes on when the proper number of turns have been completed by blinking a segment or otherwise giving a visual warning. When resetting the code of a combination lock, as is well known to those skilled in the art, the dial must be offset by a predetermined amount in the usual lock to align the combination numbers with the change index mark rather than the zero index mark. Change mode display can be incorporated in the present lock assembly by causing the displayed numbers to be offset from their normal positions by the proper amount so that when the opening combination has been dialed, the hub releasing cams of the tumbler wheels will be properly aligned with a change key in the combination lock case permitting resetting of the combination in the usual manner.

The microprocessor may also be programmed to cause it to produce a special pattern on the display 46 and keep it there while the dial is being used when the battery becomes weak, thus providing readily detectable indication that the battery should be replaced.

As was previously stated, battery energy is conserved by having the lock in off condition until rotation is initialized and sensed by closing of the switch 54 by the protrusion 53 on the encoder hub. Similarly, when the lock has been opened by dialing the proper combination and then positioning the dial at the zero position to drop the fence lever into the gates and retract the bolt, the microprocessor is preferably programmed to turn off the display after a certain time delay, for example 5 or 10 seconds after turning to the zero or dial opening position, by incorporating deactivate logic in the microprocessor, so that no more energy drain on the battery occurs until the lock is restarted.

We claim:

1. A selectively illuminated digit display combination lock dial assembly to be coupled to a rotatable operating spindle of a plural tumbler wheel combination lock for dialing a lock opening combination of numbers, comprising a generally circular rotatable dial member for manual rotation through clockwise and counterclockwise plural revolutions to dial the numbers of the combination, a dial backup case to be mounted on a security container having a coupling member journaled for rotation therein providing means to be connected with said spindle and with said dial member for transferring rotation of the dial member to the spindle, the backup case having a sight passage and digit numeric generating and display device located outwardly of the dial member periphery to generate and visually display numbers signifying the dial member angular positions during dial rotation, encoder disc means rotated in correlation with said coupling means having plural light passing and intercepting zones and light emitting and sensing optic sensors adjacent said zones for producing electrical count signals signifying rotary position and direction of rotation of the dial member during movement thereof, electronic means responsive to said signals for counting said count signals and sensing direction of dial rotation to monitor and sense number of complete dial revolutions from a predetermined starting position in a first direction and activate the numeric display to show numeric dial positions upon reaching a first number of revolutions and to count and sense direction of rotation upon successive dial revolutions in opposite directions through a predetermined sequence and activate the numeric display to show numeric dial positions when predetermined numbers of revolutions are reached in the sequence.

2. A combination lock dial assembly as defined in claim 1, wherein said digit numeric display device is a two digit LED display of plural stroke segments for each digit unit, said electronic means having display control means activating said LED digit units to display numerals only after the dial has been rotated a predetermined number of plural revolutions in a first dial operating direction and for terminating activation of the LED digit units upon reversal of direction of rotation of the dial and for a predetermined number of plural dial revolutions in the opposite direction and then activate the LED digit units to display numerals until another direction reversal of dial rotation.

3. A combination lock dial assembly as defined in claim 1, wherein said dial backup case is a cylindrical housing of larger diameter than said dial member, the dial member having its axis of rotation spaced vertically below the center of said cylindrical housing disposing the lowermost peripheral portions of the dial member adjacent but within the cylinder defined by the housing and spacing the uppermost portions of the dial member periphery and cylinder a distance receiving said sight opening there between.

4. A combination lock dial assembly as defined in claim 3, wherein said digit numeric display device is a two digit LED display of plural stroke segments for each digit unit, said electronic means having display control means activating said LED digit units to display numerals only after the dial has been rotated a predetermined number of plural revolutions in a first dial operating direction and for terminating activation of the LED digit units upon reversal of direction of rotation of the dial and for a predetermined number of plural dial revolutions in the opposite direction and then activate the LED digit units to display numerals until another direction reversal of dial rotation.

5. A combination lock dial assembly as defined in claim 3, wherein said encoder disc means including a skirt-like circular rim portion having alternating gaps and teeth rotatable with the dial member in a path intercepting light passing between the light emitting and light sensing portions of the optic sensors providing at least as many light pulses and count signal pulses per dial revolution as the number of dial increments to be associated with the dial member.

6. A combination lock dial assembly as defined in claim 5, wherein said digit numeric display device is a two digit LED display of plural stroke segments for each digit unit, said electronic means having display control means activating said LED digit units to display numerals only after the dial has been rotated a predetermined number of plural revolutions in a first dial operating direction and for terminating activation of the LED digit units upon reversal of direction of rotation of the dial and for a predetermined number of plural dial revolutions in the opposite direction and then activate the LED digit units to display numerals until another direction reversal of dial rotation.

7. A combination lock dial assembly as defined in claim 5, wherein said optic sensors comprise two pairs of light emitters and associated light sensors providing two light beams, one of which is located near the outer ends of the teeth and the other spaced toward the roots of the teeth enabling sensing of direction of dial and encoder rotation from the waveform edges of the resulting light pulses and count signal pulses.

8. A combination lock dial assembly as defined in claim 7, wherein said digit numeric display device is a two digit LED display of plural stroke segments for each digit unit, said electronic means having display control means activating said LED digit units to display numerals only after the dial has been rotated a predetermined number of plural revolutions in a first dial operating direction and for terminating activation of the LED digit units upon reversal of direction of rotation of the dial and for a predetermined number of plural dial revolutions in the opposite direction and then activate the LED digit units to display numerals until another direction reversal of dial rotation.

9. A combination lock dial assembly as defined in claim 5, wherein one of the teeth on said rim portion of the encoder disc means is shorter than the remaining teeth to indicate a start count reference position for the dial member upon commencement of dialing the opening combination by producing a distinctive optical signal from the remaining teeth.

10. A combination lock dial assembly as defined in claim 9, wherein said optic sensors comprise two pairs of light emitters and associated light sensors providing two light beams, one of which is located near the outer ends of the teeth and the other spaced toward the roots of the teeth enabling sensing of direction of dial and encoder rotation from the waveform edges of the resulting light pulses and count signal pulses.

11. A combination lock dial assembly as defined in claim 9, wherein said digit numeric display device is a two digit LED display of plural stroke segments for each digit unit, said electronic means having display control means activating said LED digit units to display numerals only after the dial has been rotated a predetermined number of plural revolutions in a first dial operating direction and for terminating activation of the LED digit units upon reversal of direction of rotation of the dial and for a predetermined number of plural dial revolutions in the opposite direction and then activate the LED digit units to display numerals until another direction reversal of dial rotation.

12. A combination lock dial assembly as defined in claim 1, wherein said encoder disc means including a skirt-like circular rim portion having alternating gaps and teeth rotatable with the dial member in a path intercepting light passing between the light emitting and light sensing portions of the optic sensors providing at least as many light pulses and count signal pulses per dial revolution as the number of dial increments to be associated with the dial member.

13. A combination lock dial assembly as defined in claim 12, wherein said digit numeric display device is a two digit LED display of plural stroke segments for each digit unit, said electronic means having display control means activating said LED digit units to display numerals only after the dial has been rotated a predetermined number of plural revolutions in a first dial operating direction and for terminating activation of the LED digit units upon reversal of direction of rotation of the dial and for a predetermined number of plural dial revolutions in the opposite direction and then activate the LED digit units to display numerals until another direction reversal of dial rotation.

14. A combination lock dial assembly as defined in claim 12, wherein said optic sensors comprise two pairs of light emitters and associated light sensors providing two light beams, one of which is located near the outer ends of the teeth and the other spaced toward the roots of the teeth enabling sensing of direction of dial and encoder rotation from the waveform edges of the resulting light pulses and count signal pulses.

15. A combination lock dial assembly as defined in claim 14, wherein said digit numeric display device is a two digit LED display of plural stroke segments for each digit unit, said electronic means having display control means activating said LED digit units to display numerals only after the dial has been rotated a predetermined number of plural revolutions in a first dial operating direction and for terminating activation of the LED digit units upon reversal of direction of rotation of the dial and for a predetermined number of plural dial revolutions in the opposite direction and then activate the LED digit units to display numerals until another direction reversal of dial rotation.

16. A combination lock dial assembly as defined in claim 12, wherein one of the teeth on said rim portion of the encoder disc means is shorter than the remaining teeth to indicate a start count reference position for the dial member upon commencement of dialing the opening combination by producing a distinctive optical signal from the remaining teeth.

17. A combination lock dial assembly as defined in claim 16, wherein said digit numeric display device is a two digit LED display of plural stroke segments for each digit unit, said electronic means having display control means activating said LED digit units to display numerals only after the dial has been rotated a predetermined number of plural revolutions in a first dial operating direction and for terminating activation of the LED digit units upon reversal of direction of rotation of the dial and for a predetermined number of plural dial revolutions in the opposite direction and then activate the LED digit units to display numerals until another direction reversal of dial rotation.

18. A combination lock dial assembly as defined in claim 16, wherein said optic sensors comprise two pairs of light emitters and associated light sensors providing two light beams, one of which is located near the outer ends of the teeth and the other spaced toward the roots of the teeth enabling sensing of direction of dial and encoder rotation from the waveform edges of the resulting light pulses and count signal pulses.

19. A combination lock dial assembly as defined in claim 18, wherein said digit numeric display device is a two digit LED display of plural stroke segments for each digit unit, said electronic means having display control means activating said LED digit units to display numerals only after the dial has been rotated a predetermined number of plural revolutions in a first dial operating direction and for terminating activation of the LED digit units upon reversal of direction of rotation of the dial and for a predetermined number of plural dial revolutions in the opposite direction and then activate the LED digit units to display numerals until another direction reversal of dial rotation.

* * * * *